US009714572B2

(12) United States Patent
Stosic

(10) Patent No.: US 9,714,572 B2
(45) Date of Patent: Jul. 25, 2017

(54) REDUCED NOISE SCREW MACHINES

(71) Applicant: The City University, London (GB)

(72) Inventor: Nikola Rudi Stosic, London (GB)

(73) Assignee: The City University, London (GB)

( * ) Notice: Subject to any disclaimer, the term of this patent is extended or adjusted under 35 U.S.C. 154(b) by 0 days.

(21) Appl. No.: 14/394,577

(22) PCT Filed: Apr. 3, 2013

(86) PCT No.: PCT/GB2013/050877
§ 371 (c)(1),
(2) Date: Oct. 15, 2014

(87) PCT Pub. No.: WO2013/156754
PCT Pub. Date: Oct. 24, 2013

(65) Prior Publication Data

US 2015/0086406 A1 Mar. 26, 2015

(30) Foreign Application Priority Data

Apr. 19, 2012 (GB) ..... 1206894.6

(51) Int. Cl.
*F03C 4/00* (2006.01)
*F04C 2/00* (2006.01)
(Continued)

(52) U.S. Cl.
CPC ..... *F01C 1/16* (2013.01); *F01C 1/084* (2013.01); *F04C 2/16* (2013.01); *F04C 18/084* (2013.01);
(Continued)

(58) Field of Classification Search
CPC ..... F04C 18/16; F04C 18/084; F04C 2/16; F04C 29/06; F04C 2250/301; F01C 1/16; F01C 1/084; F01C 1/18; Y10T 29/49242
(Continued)

(56) References Cited

U.S. PATENT DOCUMENTS 3,773,444 A * 11/1973 Koch ..... F01C 1/084 418/201.3
4,140,445 A * 2/1979 Schibbye ..... F01C 1/084 418/201.3
(Continued)

FOREIGN PATENT DOCUMENTS

CN 201891440 7/2011
EP 0166531 A1 1/1986
(Continued)

OTHER PUBLICATIONS

Stosic, Nikola et al.; "Development of a Rotor Profile for Silent Screw Compressor Operation" International Conference Compressors and their Systems; pp. 1-12; Dec. 11, 2007; London, U.K.
(Continued)

*Primary Examiner* — Theresa Trieu
(74) *Attorney, Agent, or Firm* — Stevens & Showalter LLP

(57) ABSTRACT

A reduced noise screw expander is described, which comprises a main rotor and a gate rotor each having an 'N' profile. The rotors are designed so that the torque on the gate rotor caused by pressure forces is in the same direction as the torque on the gate rotor caused by frictional drag forces. A method of designing a screw machine exhibiting reduced noise is also described. The screw machine has two or more rotors having an 'N' profile, and the method involves determining a ratio $r/r_1$, where r is the main rotor addendum and $r_1$ is the radius of the rack round side, and ensuring that this ratio is greater than 1.1 where the screw machine is to be a screw compressor or less than or equal to 1.1 where the screw machine is to be a screw expander.

3 Claims, 8 Drawing Sheets

(51) Int. Cl.

| | |
|---|---|
| ***F04C 18/00*** | (2006.01) |
| ***F01C 1/16*** | (2006.01) |
| ***F04C 18/08*** | (2006.01) |
| ***F04C 2/16*** | (2006.01) |
| ***F04C 18/16*** | (2006.01) |
| ***F01C 1/08*** | (2006.01) |
| *F04C 29/06* | (2006.01) |

(52) U.S. Cl.
CPC ..... *F04C 18/16* (2013.01); *F04C 29/06* (2013.01); *F04C 2250/301* (2013.01); *Y10T 29/49242* (2015.01)

(58) Field of Classification Search
USPC ..... 418/201.1, 201.3, 150, 189–190; 29/888.023
See application file for complete search history.

(56) References Cited

U.S. PATENT DOCUMENTS

| | | | | |
|---|---|---|---|---|
| 4,938,672 A | | 7/1990 | Ingalls | |
| 5,044,906 A | * | 9/1991 | Tsuboi | F04C 18/084 418/150 |
| 5,066,205 A | * | 11/1991 | Ingalls | F01C 1/084 418/201.3 |
| 5,947,713 A | * | 9/1999 | Ohman | F01C 1/084 418/201.3 |
| 6,167,771 B1 | * | 1/2001 | Kumar | F04C 18/084 74/458 |
| 6,296,461 B1 | * | 10/2001 | Stosic | F04C 18/084 418/201.3 |
| 2011/0189044 A1 | * | 8/2011 | Cavatorta | F04C 18/16 418/201.3 |

FOREIGN PATENT DOCUMENTS

| | | |
|---|---|---|
| GB | 1197432 A | 7/1970 |
| GB | 1503488 A | 3/1978 |
| GB | 2092676 A | 8/1982 |
| GB | 2106186 A | 4/1983 |
| GB | 2112460 A | 7/1983 |
| GB | 2418455 A | 3/2006 |
| WO | 9743550 A1 | 11/1997 |

OTHER PUBLICATIONS

Stosic, Nikola et al.; "Three Decades of Modern Practice in Screw Compressors", International Compressor Engineering Conference; pp. 1-9; 2010; Purdue University; School of Mechanical Engineering; West Lafayette, IN.

Papastefanou, M.; International Search Report; Application No. PCT/GB2013/050877; Jun. 6, 2013; European Patent Office; Rijswijk, Netherlands.

Zheng, Xia; Summary Translation of Office Action Issued in Chinese Counterpart Patent Application; Chinese Application No. CN104379936A; Mar. 2, 2016.

* cited by examiner

REDUCED NOISE SCREW MACHINES

FIELD OF THE INVENTION

This invention relates generally to screw machines, and more specifically to screw machines having reduced noise levels. The invention also relates to design principles and methods for manufacturing screw machines having reduced noise levels, and rotors for such machines.

BACKGROUND OF THE INVENTION

One of the most successful positive-displacement machines is the plural-screw machine, which is most commonly embodied as a twin-screw machine. Such machines are disclosed in UK Patent Nos. GB 1197432, GB 1503488 and GB 2092676 to Svenska Rotor Maskiner (SRM).

Screw machines can be used as compressors or expanders. Positive-displacement compressors are commonly used to supply compressed air for general industrial applications, such as to power air-operated construction machinery, whilst positive-displacement expanders are increasingly popular for use in power generation. Screw machines for use as compressors will be referred to in this specification simply as screw compressors, whilst screw machines for use as expanders will be referred to herein simply as screw expanders.

Screw compressors and screw expanders comprise a casing having at least two intersecting bores. The bores accommodate respective meshing helical lobed rotors, which contra-rotate within the fixed casing. The casing encloses the rotors totally, in an extremely close fit. The central longitudinal axes of the bores are coplanar in pairs and are usually parallel. A male (or 'main') rotor and a female (or 'gate') rotor are mounted to the casing on bearings for rotation about their respective axes, each of which coincides with a respective one of the bore axes in the casing.

The rotors are normally made of metal such as mild steel but they may be made of high-speed steel. It is also possible for the rotors to be made of ceramic materials. Normally, if of metal, they are machined but alternatively they can be ground or cast.

The rotors each have helical lands, which mesh with helical grooves between the lands of at least one other rotor. The meshing rotors effectively form one or more pairs of helical gear wheels, with their lobes acting as teeth. Viewed in cross-section, the or each male rotor has a set of lobes corresponding to the lands and projecting outwardly from its pitch circle. Similarly viewed in cross-section, the or each female rotor has a set of depressions extending inwardly from its pitch circle and corresponding to the grooves of the female rotor(s). The number of lands and grooves of the male rotor(s) may be different to the number of lands and grooves of the female rotor(s).

Prior art examples of rotor profiles are illustrated in FIGS. 1(*a*) to 1(*d*) and 2(*a*) to 2(*d*) of the accompanying drawings and will be described in more detail later.

The principle of operation of a screw compressor or a screw expander is based on volumetric changes in three dimensions. The space between any two successive lobes of each rotor and the surrounding casing forms a separate working chamber. The volume of this chamber varies as rotation proceeds due to displacement of the line of contact between the two rotors. The volume of the chamber is a maximum where the entire length between the lobes is unobstructed by meshing contact between the rotors. Conversely the volume of the chamber is a minimum, with a value of nearly zero, where there is full meshing contact between the rotors at the end face.

Considering the example of a screw expander, fluid to be expanded enters the screw expander through an opening that forms a high-pressure or inlet port, situated mainly in a front plane of the casing. The fluid thus admitted fills the chambers defined between the lobes. The trapped volume in each chamber increases as rotation proceeds and the contact line between the rotors recedes. At the point where the inlet port is cut off, the filling or admission process terminates and further rotation causes the fluid to expand as it moves downstream through the screw expander.

Further downstream, at the point where the male and female rotor lobes start to reengage, a low-pressure or discharge port in the casing is exposed. That port opens further as further rotation reduces the volume of fluid trapped between the lobes and the casing. This causes the fluid to be discharged through the discharge port at approximately constant pressure. The process continues until the trapped volume is reduced to virtually zero and substantially all of the fluid trapped between the lobes has been expelled.

The process is then repeated for each chamber. Thus, there is a succession of filling, expansion and discharge processes achieved in each rotation, dependent on the number of lobes in the male and female rotors and hence the number of chambers between the lobes. One of the rotors of a screw expander is typically connected to a generator for generating electricity.

A screw compressor essentially operates in reverse to a screw expander. For example, if the rotors of the screw expander were turned in the reverse direction (e.g. by operating the generator as a motor), then fluid to be compressed would be drawn in through the low-pressure port and compressed fluid would be expelled through the high-pressure port.

As the rotors rotate, the meshing action of the lobes is essentially the same as that of helical gears. In addition, however, the shape of the lobes must be such that at any contact position, a sealing line is formed between the rotors and between the rotors and the casing in order to prevent internal leakage between successive chambers. A further requirement is that the chambers between the lobes should be as large as possible, in order to maximise fluid displacement per revolution. Also, the contact forces between the rotors should be low in order to minimise internal friction losses and to minimise wear.

As manufacturing limitations dictate that there will be small clearances between the rotors and between the rotors and the casing, the rotor profile is the most important feature in determining the flow rate and efficiency of a screw machine. Several rotor profiles have been tried over the years, with varying degrees of success.

The earliest screw machines used a very simple symmetric rotor profile, as shown in FIG. 1(*a*). Viewed in cross-section, the male rotor 10 comprises part-circular lobes 12 equi-angularly spaced around the pitch circle, whose centres of radius are positioned on the pitch circle 14. The profile of the female rotor 16 simply mirrors this with an equivalent set of part-circular depressions 18. Symmetric rotor profiles such as this have a very large blow-hole area, which creates significant internal leakage. This excludes symmetric rotor profiles from any applications involving a high pressure ratio or even a moderate pressure ratio.

To solve this problem, SRM introduced its 'A' profile, shown in FIG. 1(*b*) and disclosed in various forms in the aforementioned UK Patent Nos. GB 1197432, GB 1503488 and GB 2092676. The 'A' profile greatly reduced internal leakage and thereby enabled screw compressors to attain efficiencies of the same order as reciprocating machines. The Cyclon profile shown in FIG. 1(*c*) reduced leakage even further but at the expense of weakening the lobes of the female rotors 16. This risks distortion of the female rotors 16 at high pressure differences, and makes them difficult to manufacture. The Hyper profile shown in FIG. 1(*d*) attempted to overcome this by strengthening the female rotors 16.

In all of the above prior art rotor profiles, the relative motion between the meshed rotors is a combination of rotation and sliding.

Against this background, the Applicant developed the 'N' rotor profile as disclosed in its International Patent Application published as WO 97/43550. Key content of WO 97/43550 is reproduced below. References in this specification to the rotor profile refer to the profile of the invention that is described and defined in WO 97/43550 and reproduced below.

The 'N' rotor profile is characterised in that, as seen in cross section, the profiles of at least those parts of the lobes projecting outwardly of the pitch circle of the male rotor(s) and the profiles of at least the depressions extending inwardly of the pitch circle of the female rotor(s) are generated by the same rack formation. The latter is curved in one direction about the axis of the male rotor(s) and in the opposite direction about the axis of the female rotor(s), the portion of the rack which generates the higher pressure flanks of the rotors being generated by rotor conjugate action between the rotors.

Advantageously, a portion of the rack, preferably that portion which forms the higher pressure flanks of the rotor lobes, has the shape of a cycloid. Alternatively, this portion may be shaped as a generalized parabola, for example of the form: $ax+by^q=1$.

Normally, the bottoms of the grooves of the male rotor(s) lie inwardly of the pitch circle as 'dedendum' portions and the tips of the lands of the female rotor(s) extend outwardly of its pitch circle as 'addendum' portions. Preferably, these dedendum and addendum portions are also generated by the rack formation.

The main or male rotor 1 and gate or female rotor 2 shown in the diagrammatic cross section of a twin-screw machine of FIG. 2(*a*) roll on their pitch circles, $P_1$, $P_2$ about their centres $O_1$, and $O_2$ through respective angles $\psi$ and $\tau=Z_1/Z_2\psi=\psi/i$ The pitch circles P have radii proportional to the number of lands and grooves on the respective rotors.

If an arc is defined on either main or gate rotor as an arbitrary function of an angular parameter $\phi$ and denoted by subscript d:

$$x_d=x_d(\phi) \tag{1}$$

$$y_d=y_d(\phi) \tag{2}$$

the corresponding arc on the other rotor is a function of both $\phi$ and $\psi$:

$$x=x(\phi,\psi)=-a\cos(\psi/i)+x_d\cos k\psi+y_d\sin k\psi \tag{3}$$

$$y=y(\phi,\psi)=a\sin(\psi,i)-x_d\sin k\psi+y_d\cos k\psi \tag{4}$$

$\psi$ is the rotation angle of the main rotor for which the primary and secondary arcs have a contact point. This angle meets the conjugate condition described by Sakun in *Vintovie kompressori*, Mashgiz Leningrad, 1960:

$$(\delta x_d/\delta\phi)(\delta y_d/\delta\psi)-(\delta x_d/\delta\psi)(\delta y_d/\delta\phi)=0 \tag{5}$$

which is the differential equation of an envelope of all 'd' curves. Its expanded form is:

$$(\delta y_d/\delta x_d)((a/i)\sin\psi-ky_d)-(-(a/i)\cos\psi+kx_d)=0 \tag{6}$$

This can be expressed as a quadratic equation of $\sin\psi$. Although it can be solved analytically, its numerical solution is recommended due to its mixed roots. Once determined, $\psi$ is inserted in (3) and (4) to obtain conjugate curves on the opposite rotor. This procedure requires the definition of only one given arc. The other arc is always found by a general procedure.

These equations are valid even if their coordinate system is defined independently of the rotors. Thus, it is possible to specify all 'd' curves without reference to the rotors. Such an arrangement enables some curves to be expressed in a more simple mathematical form and, in addition, can simplify the curve generating procedure.

A special coordinate system of this type is a rack (rotor of infinite radius) coordinate system, indicated at R in FIG. 2(*b*), which shows one unit of a rack for generating the profiles of the rotors shown in FIG. 2(*a*). An arc on the rack is then defined as an arbitrary function of a parameter:

$$x_d=x_d(\phi) \tag{7}$$

$$y_d=y_d(\phi) \tag{8}$$

Secondary arcs on the rotors are derived from this as a function of both $\phi$ and $\psi$ $$x=x(\phi,\psi)=x_d\cos\psi-(y_d-r_w\psi)\sin\psi \tag{9}$$

$$y=y(\phi,\psi)+x_d\sin\psi+(y_d-r_w\psi)\cos\psi \tag{10}$$

$\psi$ represents a rotation angle of the rotor where a given arc is projected, defining a contact point. This angle satisfies the condition (5) which is:

$$(dy_d/dx_d)(r_w\psi-y_d)-(r_w-x_d)=0 \tag{11}$$

The explicit solution $\psi$ is then inserted into (9) and (10) to find conjugate arcs on rotors.

FIG. 2(*c*) shows the relationship of the rack formation of FIG. 2(*b*) to the rotors shown in FIG. 2(*a*), and shows the rack and rotors generated by the rack. FIG. 2(*d*) shows the outlines of the rotors shown in FIG. 2(*c*) superimposed on a prior art rotor pair by way of comparison.

Wherever curves are given, their convenient form may be:

$$ax_d^p+by_d^q=1 \tag{12}$$

which is a 'general circle' curve. For p=q=2 and a=b=1/r it is a circle. Unequal a and b will give ellipses; a and b of opposite sign will give hyperbolae; and p=1 and q=2 will give parabolae.

In addition to the convenience of defining all given curves with one coordinate system, rack generation offers two advantages compared with rotor coordinate systems: a) a rack profile represents the shortest contact path in comparison with other rotors, which means that points from the rack will be projected onto the rotors without any overlaps or other imperfections; b) a straight line on the rack will be projected onto the rotors as involutes.

In order to minimize the blow hole area on the high pressure side of a rotor profile, the profile is usually produced by a conjugate action of both rotors, which undercuts the high pressure side of them. The practice is widely used: in GB 1197432, singular points on main and gate rotors are used; in GB 2092676 and GB 2112460 circles were used; in GB 2106186 ellipses were used; and in EP 0166531 parabolae were used. An appropriate undercut was not previously achievable directly from a rack. It was found that there exists only one analytical curve on a rack which can exactly replace the conjugate action of rotors. This is preferably a cycloid, which is undercut as an epicycloid on the main rotor and as a hypocycloid on the gate rotor. This is in contrast to the undercut produced by singular points which produces epicycloids on both rotors. The deficiency of this is usually minimized by a considerable reduction in the outer diameter of the gate rotor within its pitch circle. This reduces the blow-hole area, but also reduces the throughput.

A conjugate action is a process when a point (or points on a curve) on one rotor during a rotation cuts its (or their) path(s) on another rotor. An undercut occurs if there exist two or more common contact points at the same time, which produces 'pockets' in the profile. It usually happens if small curve portions (or a point) generate long curve portions, when considerable sliding occurs.

The 'N' rotor profile overcomes this deficiency because the high pressure part of a rack is generated by a rotor conjugate action which undercuts an appropriate curve on the rack. This rack is later used for the profiling of both the main and gate rotors by the usual rack generation procedure.

The following is a detailed description of a simple rotor lobe shape of a rack generated profile family designed for the efficient compression of air, common refrigerants and a number of process gases, obtained by the combined procedure. This profile contains almost all the elements of modern screw rotor profiles given in the open literature, but its features offer a sound basis for additional refinement and optimisation.

The coordinates of all primary arcs on the rack are summarised here relative to the rack coordinate system.

The lobe of this profile is divided into several arcs.

The divisions between the profile arcs are denoted by capital letters and each arc is defined separately, as shown in FIG. 2(*c*).

Segment A-B is a general arc of the type $ax_d^p+by_d^q=1$ on the rack with p=0.43 and q=1.

Segment B-C is a straight line on the rack, p=q=1.

Segment C-D is a circular arc on the rack, p=q=2, a=b.

Segment D-E is a straight line on the rack.

Segment E-F is a circular arc on the rack, p=q=2, a=b.

Segment F-G is a straight line.

Segment G-H is an undercut of the arc $G_2$-$H_2$ which is a general arc of the type $ax_d^p+by_d^q=1$, p=1, q=0.75 on the main rotor.

Segment H-A on the rack is an undercut of the arc $A_1$-$H_1$, which is a general arc of the type $ax_d^p+by_d^q=1$, p=1, q=0.25 on the gate rotor.

At each junction A, . . . H, the adjacent segments have a common tangent.

The rack coordinates are obtained through the procedure inverse to equations (7) to (11).

As a result, the rack curve E-H-A is obtained and shown in FIG. 2(*c*).

FIG. 2(*d*) shows the profiles of main and gate rotors 3, 4 generated by this rack procedure superimposed on the well-known profiles 5, 6 of corresponding rotors generated in accordance with GB 2092676, in 5/7 configuration.

With the same distance between centres and the same rotor diameters, the rack-generated profiles give an increase in displacement of 2.7% while the lobes of the female rotor are thicker and thus stronger.

In a modification of the rack shown in FIG. 2(*c*), the segments GH and HA are formed by a continuous segment GHA of a cycloid of the form: $y=R_0 \cos \tau-R_p$, $y=R_0 \sin \tau-R_p\tau$, where $R_0$ is the outer radius of the main rotor (and thus of its bore) and $R_p$ is the pitch circle radius of the main rotor.

The segments AB, BC, CD, DE, EF and FG are all generated by equation (12) above. For AB, a=b, p=0.43, q=1. For the other segments, a=b=1/r, and p=q=2. The values of p and q may vary by ±10%. For the segments BC, DE and FG r is greater than the pitch circle radius of the main rotor, and is preferably infinite so that each such segment is a straight line. The segments CD and EF are circular arcs when p=q=2, of curvature a=b.

The 'N' rotor profile described above is based on the mathematical theory of gearing.

Thus, unlike any of the rotor profiles described previously with reference to FIGS. 1(*a*) to 1(*d*), the relative motion between the rotors is very nearly pure rolling: the contact band between the rotors lies very close to their pitch circles.

The 'N' rotor profile has many additional advantages over other rotor profiles, which include low torque transmission and hence small contact forces between the rotors, strong female rotors, large displacement and a short sealing line that results in low leakage. Overall its use raises the adiabatic efficiencies of screw expander machines, especially at lower tip speeds, where gains of up to 10% over other rotor profiles in current use have been recorded.

Screw machines may be 'oil-free or 'oil-flooded'. In oil-free machines, the helical formations of the rotors are not lubricated. Accordingly, external meshed 'timing' gears must be provided to govern and synchronise relative movement of the rotors. Transmission of synchronising torque between the rotors is effected via the timing gears, which therefore avoids direct contact between the meshed helical formations of the rotors. In this way, the timing gears allow the helical formations of the rotors to be free of lubricant. In oil-flooded machines, the external timing gears may be omitted, such that synchronisation of the rotors is determined solely by their meshed relationship. This necessarily implies some transmission of synchronising torque from one rotor to the other via their meshed helical formations. In that case, the helical formations of the rotors must be lubricated to avoid hard contact between the rotors, with consequent wear and probable seizure.

An oil-flooded machine relies on oil entrained in the working fluid to lubricate the helical formations of the rotors and their bearings and to seal the gaps between the rotors and between the rotors and the surrounding casing. It requires an external shaft seal but no internal seals and is simple in mechanical design. Consequently, it is cheap to manufacture, compact and highly efficient.

A problem associated with existing screw machines is noise. A significant part of the noise generated in screw machines originates from contact involving its moving parts, in particular the rotors, the gears and the bearings. This mechanical noise is caused by contact between the rotors due to pressure and inertial torque, together with torque caused by oil drag forces, acting circumferentially upon the driven rotor. It is also due to contact between the rotor shafts and bearings due to the radial and axial pressure and inertial forces. These forces should be as uniform as possible to minimise noise. Unfortunately, the radial and axial forces and rotor torque, which create the rotor contact forces, are not uniform, due to the periodic character of the pressure loads. Also, imperfections in the rotor manufacture and compressor assembly contribute significantly to non-uniform movement of the rotors, which results in non-uniform contact forces.

If the intensity of contact forces changes, rotor 'chatter' will occur. This noise is generated by the rotors when they are still in contact with one another. However, if the rotor contact is momentarily lost and then re-established, this can generate severe noise, which is known as rotor 'rattle'. Loss of contact between the rotors is caused either by manufacturing and assembly imperfections combined with point contact between the rotors, or by a change in sign (reversal) of the driven rotor torque.

As environmental protection legislation becomes stricter, the demand for reduced noise levels from all forms of machinery increases and hence the need for silent or low noise levels from screw machines becomes more significant. Whilst previous attempts have been made to reduce the noise levels in screw machines, the general approach to optimization has been an iterative process of trial and improvement. The resulting rotors have generally suffered from a loss in efficiency, and it is therefore desirable to seek a means of generating reduced-noise profiles in a manner that minimises the performance loss.

A scientific approach for reducing the noise in screw compressors has been developed by the Applicant, and is described in the prior-published paper entitled '*Development of a Rotor Profile for Silent Screw Compressor Operation*' by Stostic et al. The content of this paper is discussed below with reference to FIGS. 3(*a*)-(*c*) and FIGS. 4(*a*) and 4(*b*).

Referring to FIGS. 3(*a*)-3(*c*), screw compressor rotors are subjected to high-pressure loads. For any instantaneous angle of rotation q, the pressure p(θ) creates radial and torque forces at any cross section. The pressure, p, acts on the corresponding interlobes normal to line AB, where A and B are on the sealing line either between the rotors or on the rotor tips. Thus their position is fully defined by the rotor geometry.

At the position shown in FIG. 3(*a*), there is no contact between the rotors. Since A and B are on the circle, the overall forces $F_1$ and $F_2$ act towards the rotor axes and are purely radial. Thus there is no torque caused by pressure forces in this position. At the position shown in FIG. 3(*b*), there is only one contact point between the rotors at A. Forces $F_1$ and $F_2$ are eccentric and have both radial and circumferential components. The latter cause the pressure torque. Due to the force position, the torque on the gate rotor is significantly smaller than that on the main rotor. At the position shown in FIG. 3(*c*), both contact points are on the rotors, with overall and radial forces equal for both rotors. These also cause torque, as in FIG. 3(*b*). The coordinate system has its x, y origins in the centre of the main rotor and the x-axis is parallel to the line between the rotor centres $O_1$ and $O_2$.

The radial force components are:

$$R_x=-p\int_A^B dy=-p(y_B-y_A), R_y=-p\int_A^B dx=-p(x_B-x_A) \tag{13}$$

The pressure torque can be expressed as:

$$T = p\int_A^B x\,dx + p\int_A^B y\,dy = 0.5p(x_B^2 - x_A^2 + y_B^2 - y_A^2) \tag{14}$$

The above equations are integrated along the profile for all profile points. Then they are integrated for all angle steps to complete one revolution, given the pressure history p=p (q). Finally, the sum for all rotor interlobes is obtained after taking account of both the phase and axial shift between the interlobes.

As mentioned above, oil flooded compressors have direct contact between their rotors. In well-designed rotors, the clearance distribution will be set so that contact is first made along their contact bands, which are positioned close to the rotor pitch circles to minimise sliding motion between them and hence to reduce the danger of the rotors seizing. As shown in FIGS. 4(*b*) and 5(*b*), a main rotor 1 has a centre or axis $O_1$ and comprises lobes 20 extending outwardly from its pitch circle P1, and a gate rotor 2 has a centre or axis $O_2$ and comprises depressions 22 extending inwardly from its pitch circle P2. Depending upon the design of the rotors, and the direction in which the rotors turn, the contact band may be either on the rotor round flank as shown in FIGS. 4(*a*)-(*c*), or on the rotor flat flank as shown in FIGS. 5(*a*)-(*c*). The details in FIGS. 4(*c*) and 5(*c*) represent the rotor clearance along the rotor rack and show clearances at every point along the rack except that FIG. 4(*c*) shows contact at the round flank (as indicated by arrow A) and FIG. 5(*c*) shows contact at the flat side (as indicated by arrow B).

It is important to keep the torque direction constant to prevent any loss of rotor contact and to avoid eventual chatter and rattle. It will be appreciated that the torque on the gate rotor caused by oil drag is in an opposite direction to the direction in which the gate rotor rotates. Standard 'N' rotor screw compressors are designed such that the torque on the gate rotor due to pressure forces is in an opposite direction to the drag torque. This causes the rotors to make contact at the flat flank, which serves to minimise interlobe leakage and hence results in relatively high compressor flows and efficiencies.

However, the torque on the gate rotor caused by oil drag may be sufficient to overwhelm the pressure torque, which acts in the opposite direction to the drag torque in a standard screw compressor as described above. Stosic et al suggests that it is good practice to maintain the pressure torque smaller in absolute value than the oil drag torque on the gate rotor to avoid a change in the torque sign. However, it is difficult to predict the magnitude of the oil drag. The solution provided by Stosic et al is to redesign the rotors so that the pressure torque on the gate rotor acts in the same direction as the drag torque. This results in contact between the rotors occurring at the rotor round flank instead of at the rotor flat flank. Importantly, the pressure torque and the drag torque do not compete with one another, and hence this arrangement avoids the possibility of a change in torque sign occurring thereby reducing rattle and chatter and the associated noise.

Essentially, Stosic et al concludes that reduced noise can be achieved by redesigning standard screw compressor rotors to change the sign of the gate rotor torque resulting from pressure forces. The reduction of noise in screw expanders is not discussed in this research.

It is against this background that the present invention has been made.

BRIEF SUMMARY OF THE INVENTION

According to a first aspect of the present invention there is provided a screw expander comprising a main rotor and a gate rotor each having an 'N' profile as defined herein, wherein the rotors are designed so that the torque on the gate rotor caused by pressure forces is in the same direction as the torque on the gate rotor caused by frictional drag forces.

Whereas the rotors of prior art screw expanders are designed such that the torque caused by pressure forces acts in the opposite direction to the torque caused by frictional drag forces, the present invention realises that changing the sign of the pressure torque so that it acts in the same direction as the drag torque avoids the possibility of a change in torque sign and hence significantly reduces the noise in a screw expander resulting from rattle and chatter.

Whereas the rotors of prior art screw expanders make contact at the rotor round flank, the screw expander rotors according to the present invention are designed such that contact is made at the rotor flat flank. The sealing line at the rotor flat flank is much longer than the sealing line at the rotor round flank. Therefore, minimising the clearance at the rotor flat flank reduces the interlobe leakage more than minimising the clearance at the round flank. Consequently, the screw expanders of the present invention have higher compression flows and higher efficiency.

In view of the foregoing, it will be appreciated that careful design of 'N' rotors to ensure that the gate rotor torque resulting from pressure forces acts in the same direction as the torque caused by drag forces results in more uniform contact force between the rotors, and thus results in reduced chatter and prevents rattling.

The intensity and sign of the pressure torque at the gate rotor is determined by the sealing line coordinates and the pressure distribution within one compression or expansion cycle. The sealing line coordinates are determined by the profile coordinates, which are, in turn, determined by the input data which define the 'N' rotor coordinates. Before the present invention it was difficult to design the rotors of screw machines to ensure that the torque resulting from pressure forces was in a particular direction, and the design process generally involved an iterative process of experimentation and refinement.

Against this background and as part of the present invention, a convenient relationship has been determined for predicting the torque sign of the gate rotor caused by pressure forces. Specifically, it has been determined that the ratio between the main rotor addendum r and the rack radius $r_1$ on the rack round side defines the sign of the gate rotor torque determined by pressure forces.

BRIEF DESCRIPTION OF THE SEVERAL VIEWS OF THE DRAWING(S)

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIGS. 1(*a*)-1(*d*) illustrate prior art examples of rotor profiles;

FIGS. 2(*a*)-2(*d*) illustrate prior art examples of rotor profiles;

FIG. 3(*a*)-3(*c*) illustrate prior art examples of rotor profiles;

FIG. 4(*a*)-4(*c*) illustrate screw compressor rotors designed in accordance with the present invention which make contact on the rotor round flank;

FIG. 5(*a*)-5(*c*) illustrate screw compressor rotors designed in accordance with the prior art, which make contact on the rotor flat flank;

FIG. 7(*b*) illustrates the results of experimental tests performed on screw compressor rotors designed in accordance with the present invention;

FIG. 7(*b*) illustrates the results of experimental tests performed on screw expander rotors designed in accordance with the present invention.

DETAILED DESCRIPTION OF THE INVENTION

Figure 1A:
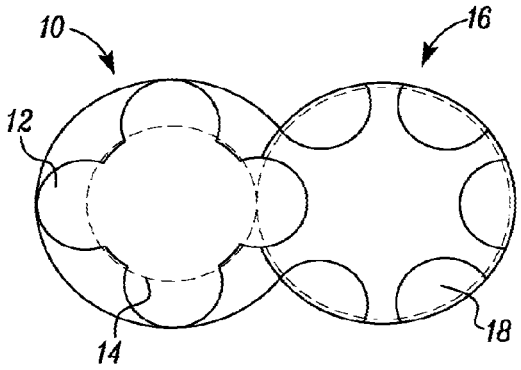
FIG. 1(a) Prior Art
Figure 1B:
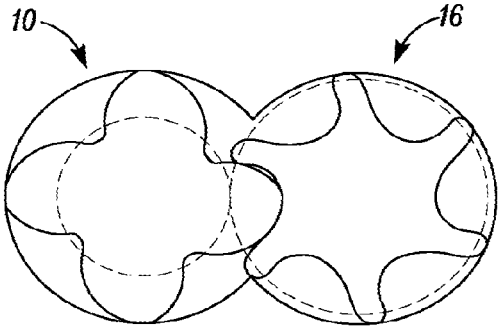
FIG. 1(b) Prior Art
Figure 1C:
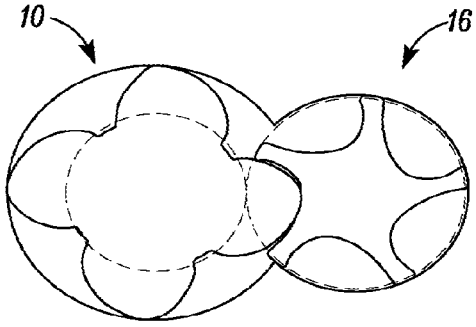
FIG. 1(c) Prior Art
Figure 1D:
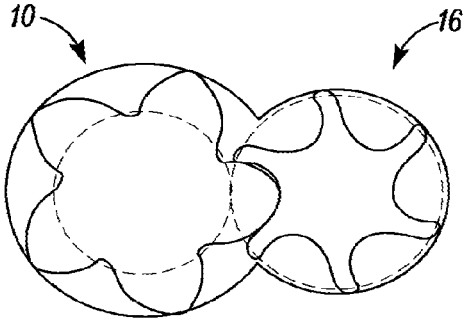
FIG. 1(d) Prior Art
Figure 2A:
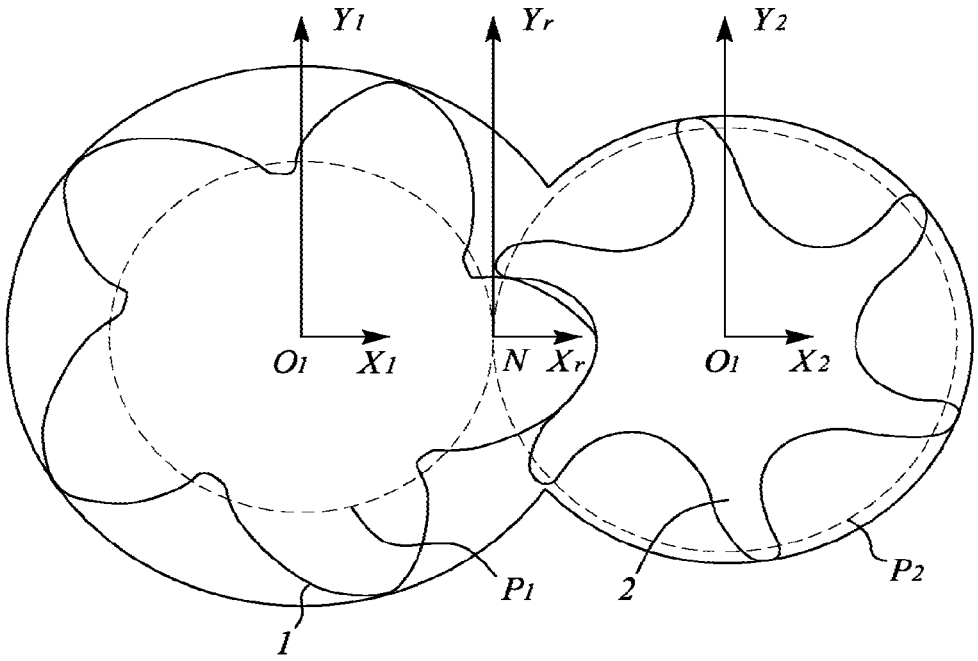
FIG. 2(a) Prior Art
Figure 2B:
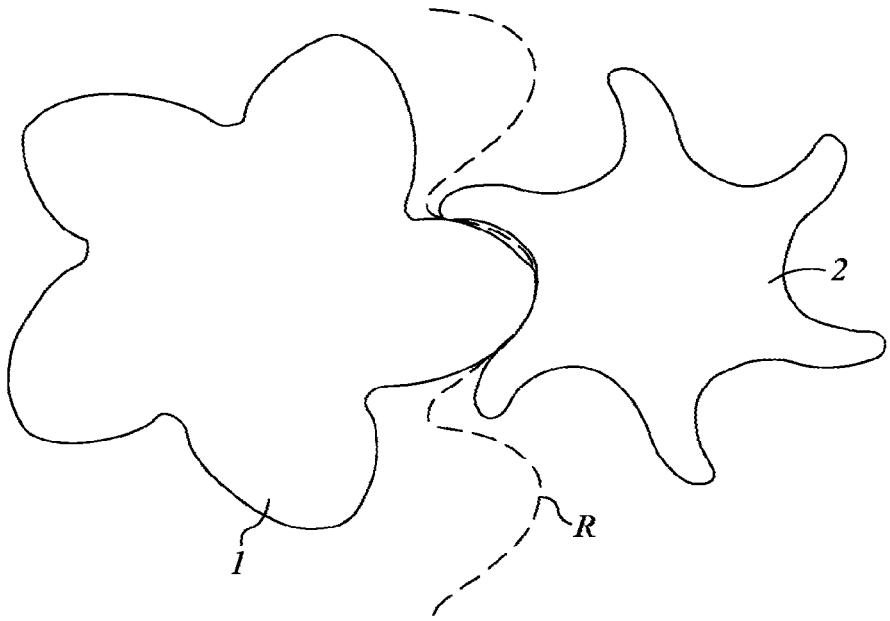
FIG. 2(b) Prior Art
Figure 2C:
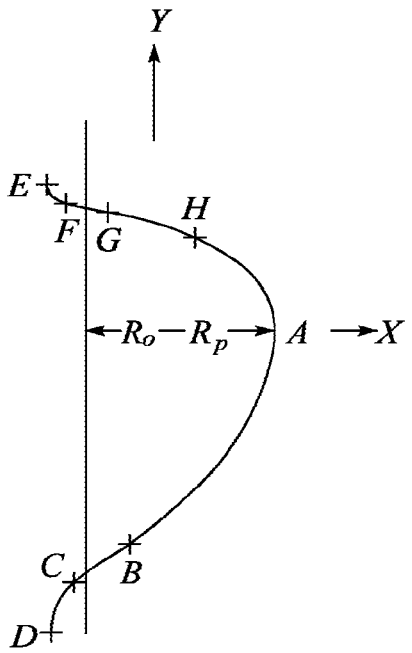
FIG. 2(c) Prior Art
Figure 2D:
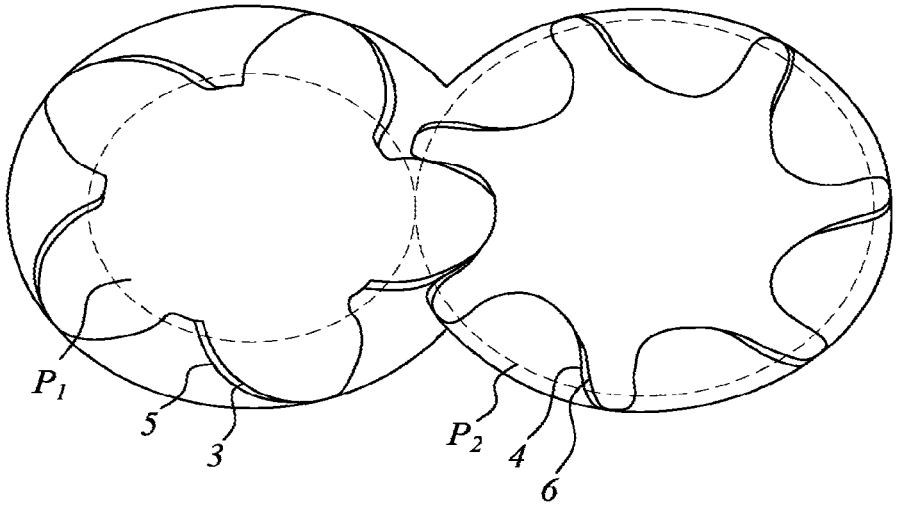
FIG. 2(d) Prior Art
Figure 3A:
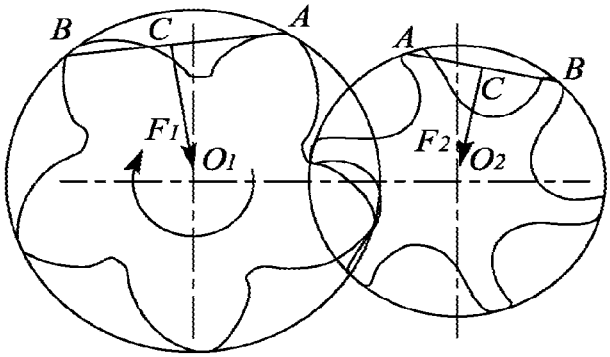
FIG. 3(a) Prior Art
Figure 3B:
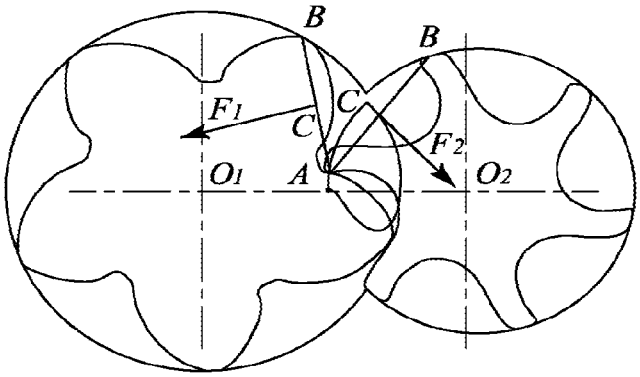
FIG. 3(b) Prior Art
Figure 3C:
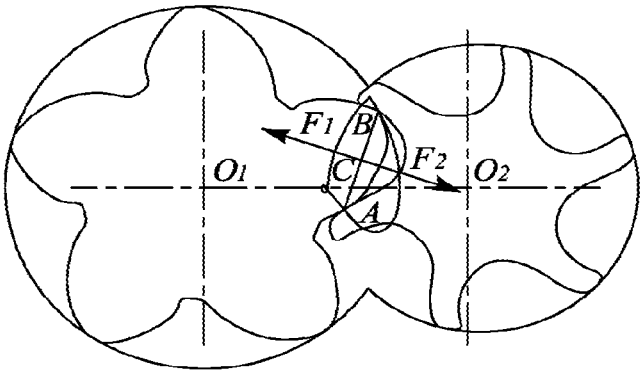
FIG. 3(c) Prior Art
Figure 4A:
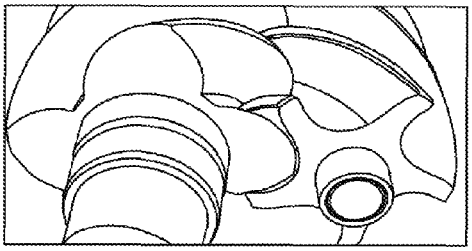
Figure 5A:
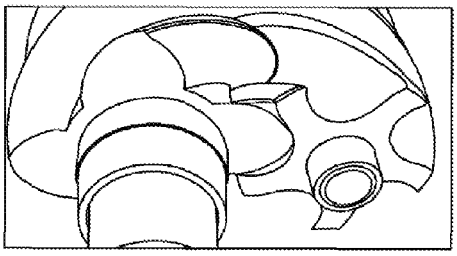
Figure 4B:
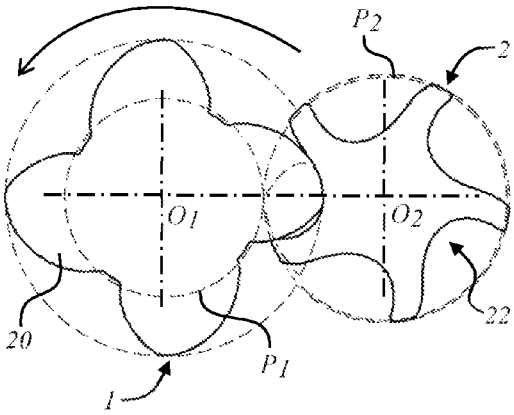
Figure 5B:
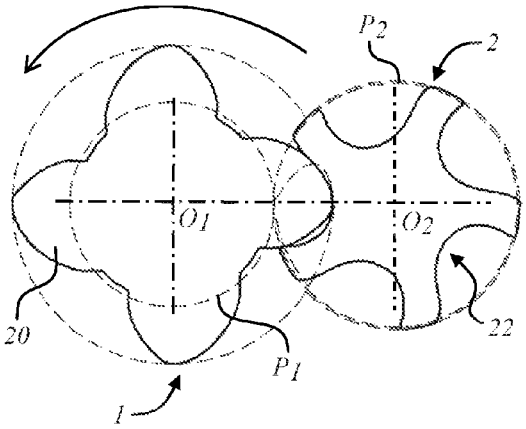
Figure 4C:
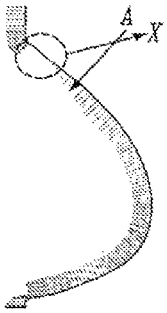
Figure 5C:
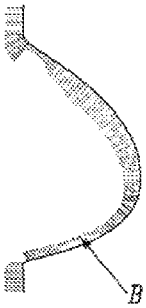
Figure 6:
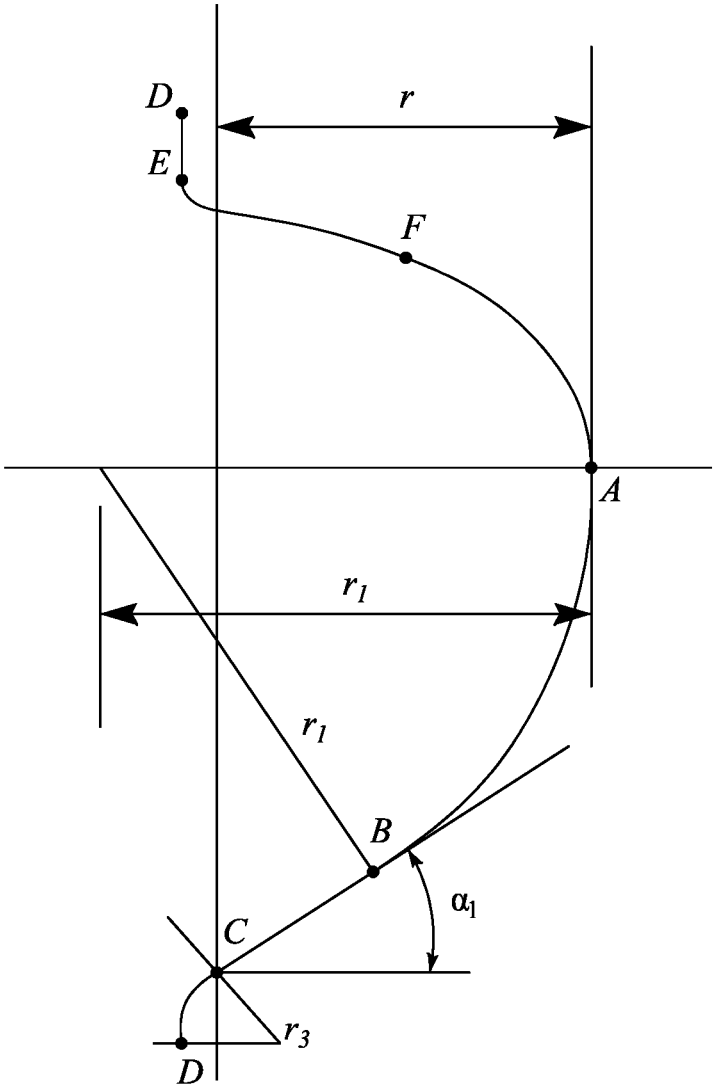
FIG. 6 illustrates an example of a rack profile for generating rotor profiles according to the present invention.

The parameters r and $r_1$ are indicated in FIG. 6, which shows an example of a rack profile. Referring to FIG. 6, the lobe of this profile is divided into several arcs similar to the profile in FIG. 2(*c*). In this example, the segment D-E is a straight line; the segment E-F is a trochoid; the segment F-A is a trochoid; the segment A-B is a circle; the segment B-C is a straight line; and the segment C-D is a circle.

Referring to FIG. 6,

- r is the main rotor addendum, which is the radial distance from the pitch circle of the main rotor to the outermost point A of the lobe;
- $r_1$ is the radius on the rack round side, i.e. the radius of the arc between points A and B in FIG. 6;
- $\alpha_1$ is the transverse pressure angle on the rack round side; and
- $r_3$ is the rack root fillet radius on the rack round side.

According to the present invention, it has been calculated that if the ratio $r/r_1$ is more than 1.1 then the gate rotor torque will be in a first direction, whilst if the ratio $r/r_1$ is equal to or less than 1.1, the gate rotor torque will be in a second direction, i.e. opposite to the first direction. Extensive experimentation has proven that a ratio $r/r_1$ of more than 1.1 results in reduced noise in the case of 'N' rotor screw compressor rotors, whilst a ratio $r/r_1$ equal to or less than 1.1 results in reduced noise for 'N' rotor screw expanders. These relationships are summarised below in equations 15 and 16.

$$\text{Compressor rotors: } \frac{r}{r_1} > 1.1 \tag{15}$$

$$\text{Expander rotors: } \frac{r}{r_1} \leq 1.1 \tag{16}$$

Accordingly, the screw expander in accordance with the first aspect of the present invention comprises r and $r_1$ parameters satisfying the condition of equation 16 above.

In accordance with a second aspect of the present invention, there is provided a method of designing a screw machine exhibiting reduced noise properties, the screw machine comprising two or more rotors having an 'N' profile as defined herein, which is generated from a rack formation, wherein the method involves determining a ratio $r/r_1$, where r is the main rotor addendum and $r_1$ is the radius of the rack round side, and ensuring that this ratio is greater than 1.1 where the screw machine is to be a screw compressor or less than or equal to 1.1 where the screw machine is to be a screw expander.

In accordance with a third aspect of the present invention, there is provided a method of manufacturing a screw machine exhibiting reduced noise properties and having two or more rotors having an 'N' profile as defined herein, which is generated from a rack formation, wherein the method comprises determining a ratio $r/r_1$, where r is the main rotor addendum and $r_1$ is the radius of the rack round side, and ensuring that this ratio is greater than 1.1 where the screw machine is to be a screw compressor or less than or equal to 1.1 where the screw machine is to be a screw expander.

Within the present inventive concept there is provided a screw machine designed or manufactured in accordance with any of the above methods.

According to a fourth aspect of the present invention there is provided a power generator comprising the screw expander of the first aspect of the present invention or a screw expander designed or manufactured in accordance with the second or third aspects of the present invention.

Tests

Two sets of rotors were designed to accommodate the above mentioned claims for reducing screw compressor and expander noise and increasing their operational reliability. The first set of rotors was for a screw compressor and the second set of rotors was for a screw expander.

The process of designing and making the compressor rotors involved modifying a standard set of 'N' profile compressor rotors. Measurements taken of the standard rotors showed that the ratio $r/r_1$ was less than 1.1, and experimental tests showed that the torque caused by pressure forces acted in an opposite direction to the drag torque. Accordingly, contact between the rotors occurred on the rotor flat flank.

The modification of the standard rotors involved increasing the transverse pressure angle $\alpha_1$ on the rack round side. Referring again to FIG. 6, it will be appreciated that increasing the angle $\alpha_1$ results in a decrease in the radius $r_1$ on the rack round side, and hence an increase in the ratio $r/r_1$. $\alpha_1$ was increased sufficiently such that the ratio $r/r_1$ was more than 1.1. This resulted in relatively thicker lobes on the gate rotor and relatively thinner lobes on the main rotor, when compared with the standard 'N' profile compressor rotors.

Figure 7A:
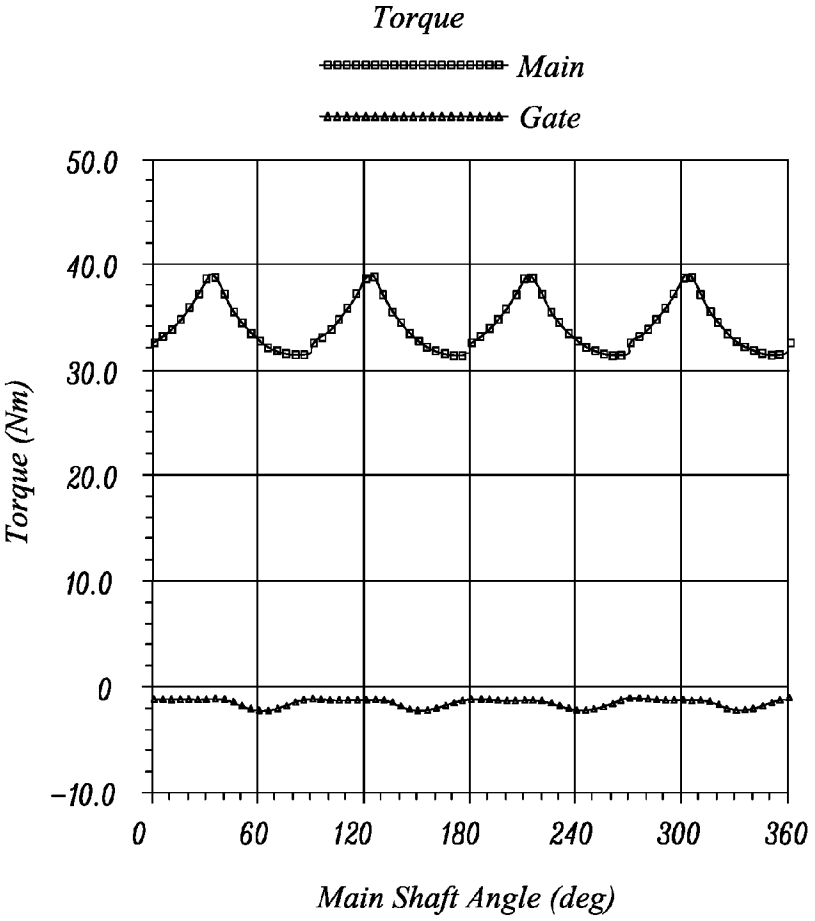
FIG. 7(*a*) illustrates the results of experimental tests performed on prior art screw compressor rotors.
Figure 7B:
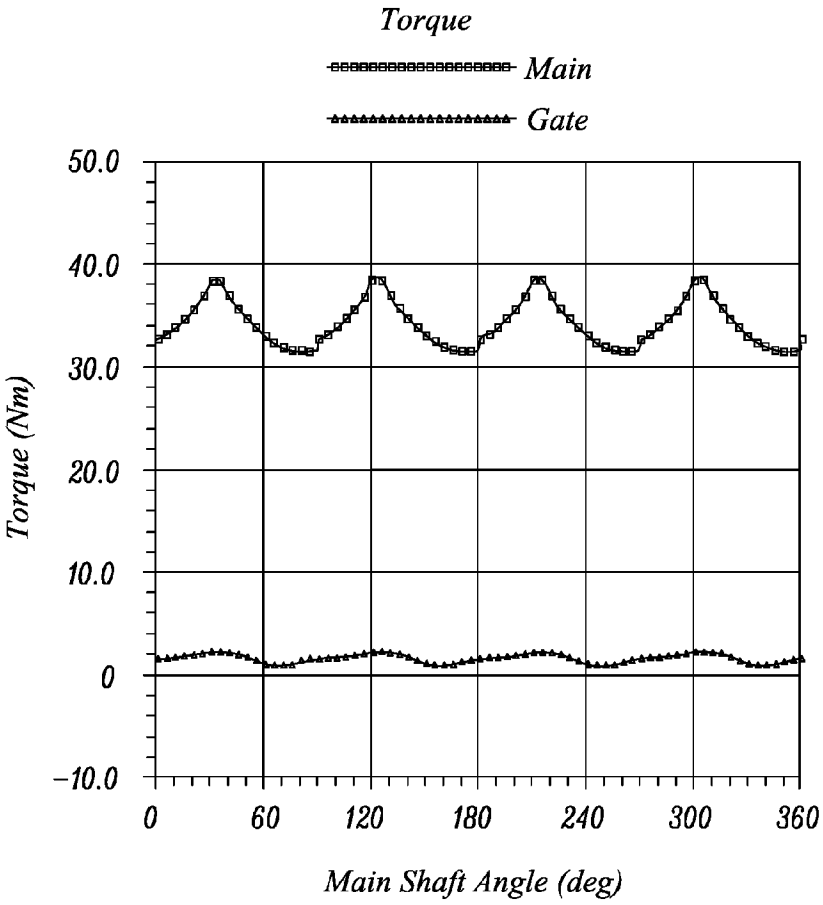

Experimental tests were performed on the standard and modified compressor rotors and the results are presented in FIGS. 7(*a*) and 7(*b*), which show two lines corresponding respectively to the main and gate rotor torques resulting from pressure forces. The main rotor torque is larger than the gate rotor torque and hence is shown above the gate rotor torque. The results for standard compressor rotors are shown in FIG. 7(*a*), whilst the results for the modified compressor rotors are shown in FIG. 7(*b*). Referring to the lower lines in both figures, it can be seen that modifying the compressor rotors caused a change in the torque sign on the gate rotor resulting from pressure forces: the torque sign on the gate rotor for standard rotors was negative, whilst the torque sign on the gate rotor for the modified rotors was positive. The tests also proved that the modified compressor rotors were significantly quieter than the standard rotors and did not suffer materially from rattle and chatter yet there was no significant loss in efficiency.

The process of designing and making the expander rotors involved modifying a standard set of 'N' profile expander rotors. Measurements taken of the standard rotors showed that the ratio $r/r_1$ was greater than 1.1, and experimental tests showed that the torque caused by pressure forces acted in an opposite direction to the drag torque. Accordingly, contact between the rotors was made on the rotor round flank.

The modification of the standard rotors involved decreasing the transverse pressure angle $\alpha_1$ on the rack round side. Referring again to FIG. 6, it will be appreciated that decreasing the angle $\alpha_1$ results in an increase in the radius $r_1$ on the rack round side, and hence a decrease in the ratio $r/r_1$. $\alpha_1$ was reduced sufficiently such that the ratio $r/r_1$ was less than 1.1. This resulted in relatively thinner lobes on the gate rotor and relatively thicker lobes on the main rotor, when compared with the standard 'N' profile expander rotors.

Figure 8A:
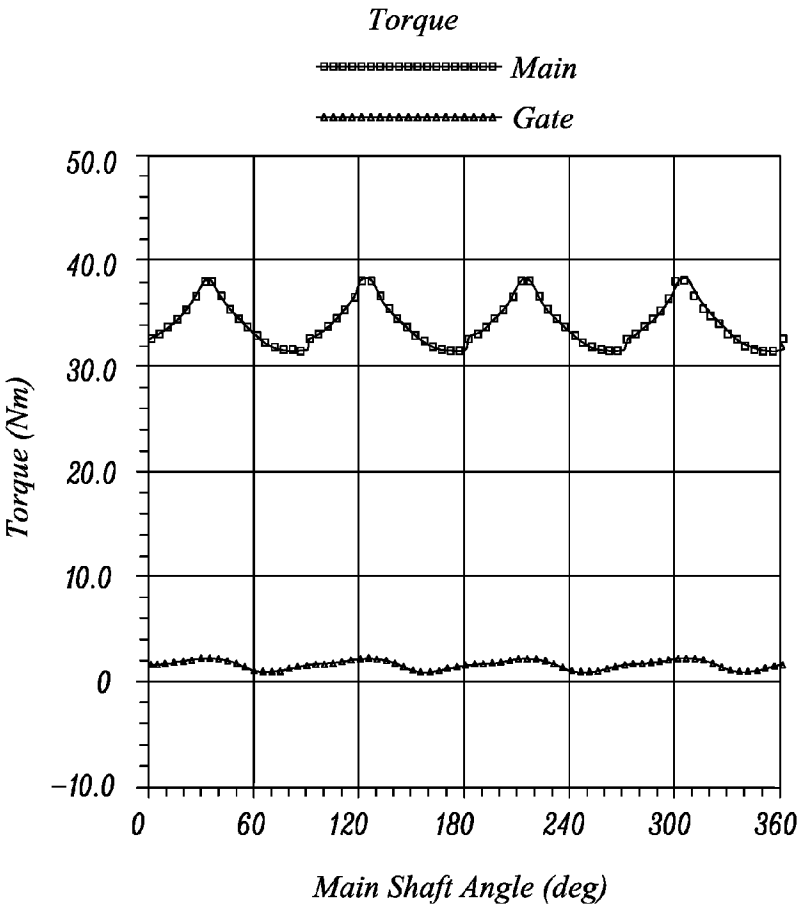
FIG. 8(*a*) illustrates the results of experimental tests performed on prior art screw expander rotors.
Figure 8B:
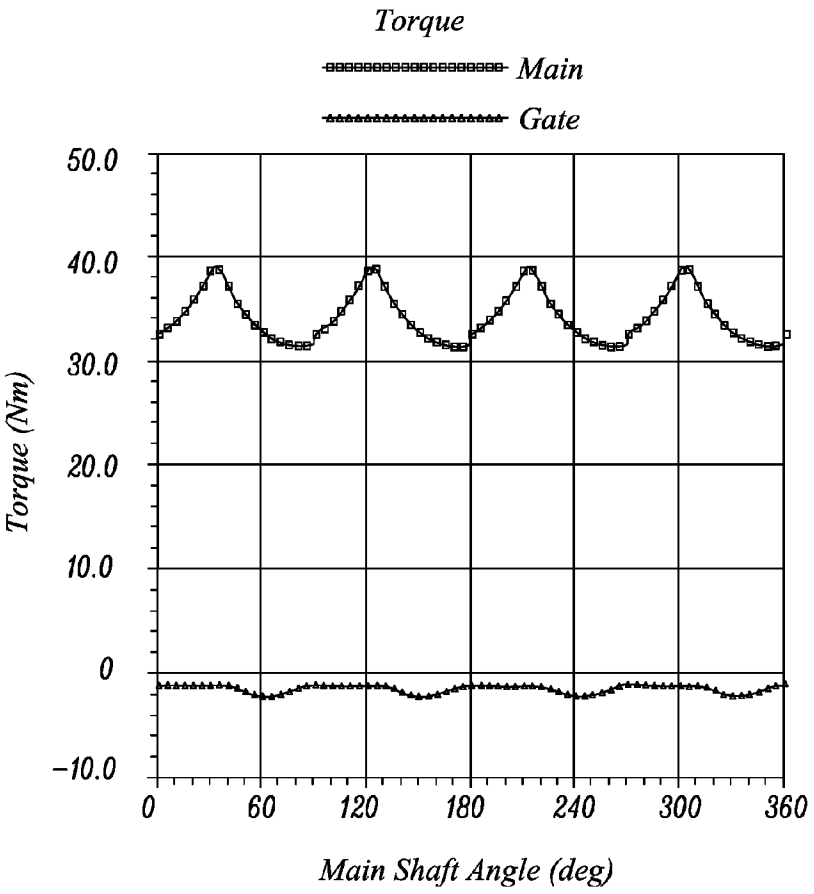

Experimental tests were performed on the standard and modified expander rotors and the results are presented in FIGS. 8(*a*) and 8(*b*), which show two lines corresponding respectively to the main and gate rotor torques resulting from pressure forces. The main rotor torque is larger than the gate rotor torque and hence is shown above the gate rotor torque. The results for standard expander rotors are shown in FIG. 8(*a*), whilst the results for the modified expander rotors are shown in FIG. 8(*b*). Referring to the lower lines in both figures, it can be seen that modifying the expander rotors caused a change in the torque sign on the gate rotor resulting from pressure forces: the torque sign on the gate rotor for standard rotors was positive, whilst the torque sign on the gate rotor for the modified rotors was negative. The tests also proved that the modified expander rotors were significantly quieter than the standard rotors and did not suffer materially from rattle and chatter and there was a slight increase in efficiency due to the contact between the modified rotors occurring on the flat flank as opposed to on the round flank in the case of the standard rotors.

Various modifications may be made to the examples described above without departing from the scope of the invention as defined in the following claims.

What is claimed is:

1. A screw expander comprising:

a main rotor and a gate rotor, wherein, when viewed in cross section, profiles of at least those parts of lobes projecting outwardly of a pitch circle of the main rotor and profiles of at least depressions extending inwardly of a pitch circle of the gate rotor are generated by a same rack formation, said rack formation being curved in one direction about an axis of the main rotor and in an opposite direction about an axis of the gate rotor, a portion of the rack formation which generates higher pressure flanks of the rotors being generated by rotor conjugate action between the rotors, and wherein the rack formation has a ratio $r/r_1$ less than or equal to 1.1, where r is a main rotor addendum and $r_1$ is a radius of a rack round side so that a torque on the gate rotor caused by pressure forces from the rotor conjugate action between the rotors is in a same direction as a torque on the gate rotor caused by frictional drag forces.

2. The screw expander of claim 1 wherein the rotors are designed such that during operation of the screw expander, contact between the rotors is made at a rotor flat flank.

3. A method of manufacturing a screw machine exhibiting reduced noise properties and having two or more rotors, the method comprising:

determining a ratio $r/r_1$, wherein r is a main rotor addendum and $r_1$ is a radius of a rack round side; and forming the screw machine such that that the ratio $r/r_1$ is greater than 1.1 where the screw machine is to be a screw compressor or less than or equal to 1.1 where the screw machine is to be a screw expander, wherein when viewed in cross section, profiles of at least those parts of lobes projecting outwardly of a pitch circle of one or more main rotors and profiles of at least depressions extending inwardly of a pitch circle of one or more gate rotors are generated by the same rack formation;

said rack formation being curved in one direction about an axis of the or each main rotor and in an opposite direction about an axis of the or each gate rotor; and, a portion of the rack formation which generates higher pressure flanks of the rotors being generated by rotor conjugate action between the rotors.

* * * * *